US008171982B2

(12) United States Patent
Franz et al.

(10) Patent No.: US 8,171,982 B2
(45) Date of Patent: May 8, 2012

(54) METHOD AND DEVICE FOR MANUFACTURING A STRIP OF METAL

(75) Inventors: Rolf Franz, Kreuztal (DE); Olaf Norman Jepsen, Siegen (DE); Christian Mengel, Siegen (DE); Michael Breuer, Hilchenbach (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 123 days.

(21) Appl. No.: 12/734,778

(22) PCT Filed: Nov. 13, 2008

(86) PCT No.: PCT/EP2008/009576
§ 371 (c)(1), (2), (4) Date: Jun. 18, 2010

(87) PCT Pub. No.: WO2009/065517
PCT Pub. Date: May 28, 2009

(65) Prior Publication Data

US 2010/0252223 A1 Oct. 7, 2010

(30) Foreign Application Priority Data

Nov. 21, 2007 (DE) ..... 10 2007 056 192

(51) Int. Cl.
*B22D 11/12* (2006.01)
*B22D 45/00* (2006.01)

(52) U.S. Cl. ..... 164/269; 164/417

(58) Field of Classification Search ..... 164/462, 164/476, 479, 269, 417, 427
See application file for complete search history.

(56) References Cited

U.S. PATENT DOCUMENTS

| | | | | |
|---|---|---|---|---|
| 4,721,152 | A * | 1/1988 | Reichelt et al. | 164/429 |
| 4,817,702 | A * | 4/1989 | Itoyama et al. | 164/432 |
| 6,192,973 | B1 | 2/2001 | Schwerdtfeger | |
| 6,280,542 | B1 | 8/2001 | Cornelissen | |
| 6,363,997 | B1 | 4/2002 | Urlau | |
| 6,527,882 | B1 | 3/2003 | Wehage | |
| 6,907,915 | B2 | 6/2005 | Hohenbichler | |
| 2010/0059196 | A1 | 3/2010 | Spitzer | |

FOREIGN PATENT DOCUMENTS

| | | |
|---|---|---|
| DE | 19852275 | 5/2000 |
| EP | 086 215 | 8/1998 |

(Continued)

OTHER PUBLICATIONS

Klaus Schwerdtfeger et al., "Further Results from Strip Casting with the single-Belt Process", ISIJ International, V. 40, No. 8, pp. 756-764.

(Continued)

*Primary Examiner* — Kevin P Kerns
(74) *Attorney, Agent, or Firm* — Abelman, Frayne & Schwab

(57) ABSTRACT

A device for manufacturing a metal strip has solidification section (3) formed as a horizontally extending conveyor element for transporting cast metal in a transport direction (F), a delivery vessel (2) for delivering liquid metal to a first location of the solidification section (3), a delivery vessel (2) for delivering liquid metal to a first location of the solidification section (3); and a device provided at or downstream of a second location spaced from the first location for maintaining a desired tension of a metal strip and including at least one driver (8, 9) for transporting the metal.

8 Claims, 5 Drawing Sheets

FOREIGN PATENT DOCUMENTS

| | | | | |
|---|---|---|---|---|
| JP | 62-142004 | A | * | 6/1987 |
| JP | 62142004 | | | 6/1987 |
| JP | 63049350 | | | 3/1988 |
| JP | 63157750 | | | 6/1988 |
| JP | 02025250 | | | 1/1990 |
| JP | 04197561 | | | 7/1992 |
| JP | 4-305347 | A | * | 10/1992 |
| JP | 05293602 | | | 11/1993 |
| JP | 05293607 | | | 11/1993 |
| JP | 08090181 | | | 4/1996 |
| JP | 08238516 | | | 9/1996 |
| JP | 08294715 | | | 11/1996 |

OTHER PUBLICATIONS

Karl-Heinz Spitzer et al., "Direct Strip Casting (DSC)—an Option for the Production of New Steel Grades", steel research, V. 74 (2003), No. 11/12, pp. 724-731.

* cited by examiner

Without loop lifter
problem: big traction changes through shear cut

Loop control active,
Traction almost constant

METHOD AND DEVICE FOR MANUFACTURING A STRIP OF METAL

RELATED APPLICATION

This application is a National Stage application of International application PCT/EP2008/009576 filed Nov. 13, 2008 which claims priority of German application DE 10 2007 056 192.1 filed Nov. 21, 2007.

BACKGROUND OF THE INVENTION

1. Field of the Invention

The invention pertains to a method for manufacturing a strip of metal, particularly of steel, wherein liquid metal is delivered to a solidification section from a pour hole, and wherein the cast metal solidifies along the solidification section. The invention furthermore pertains to a device for manufacturing a strip of metal.

2. Description of the Prior Art

The horizontal strip casting method makes it possible to cast melts of various steel types near-net shape within a strip thickness range of less than 20 mm. Systems of this type that make it possible to manufacture strips have already been described. Lightweight structural steels, in particular, with a high content of C, Mn, Al and Si can be advantageously manufactured in this case.

In the horizontal strip casting of steel, a direct association exists between the material in the liquid phase in the melt delivery region and the further processing steps of the solidified material over the cast strip. After its emergence from the casting machine and the solidification, the cast strip is delivered to the additional processing stations via a transport section. The processing steps may consist of: leveling, rolling, cutting and winding (reeling, coiling).

These or similar components of a complete system may cause tension and mass flow fluctuations in the cast strip. If the disturbances propagate in the direction of the liquid steel, casting defects can occur and the cast strip can be negatively influenced, e.g., in the form of thickness fluctuations, overflowing, edge constrictions and tearing of the strip or flow.

Lightweight structural steels that have a very long solidification interval (i.e., temperature window from the beginning of the solidification from the melt up to the complete solidification and zero-solidity or zero-viscosity temperatures depending thereon), in particular, are also intolerant to fluctuating tensions in the region of the transport section.

SUMMARY OF THE INVENTION

The invention therefore is based on the objective of additionally developing a method of the initially described type, as well as a corresponding device, such that it can also be ensured that the cast strip has a high quality if disturbances of the above-described type occur.

With respect to the method, this objective is attained, according to the invention, in that liquid metal is delivered to a first location of the solidification section that is realized in the form of a horizontally extending conveyor element, and that the solidified metal departs the conveyor element at a second location that is spaced apart from the first location in the transport direction, wherein means for maintaining the mass flow of the strip departing the solidification section and/or the tension in the strip at a desired value are provided at or downstream of the second location referred to the transport direction.

The means arranged downstream of the second location preferably maintain a specified tensile stress in the strip. The means may, in particular, maintain a tensile stress in the strip that is constant in time downstream of the second location.

A tensile stress of nearly zero can be maintained in the strip in the solidification section.

The proposed device for manufacturing a strip of metal, particularly of steel, comprises a pour hole for delivering liquid metal to a solidification section, wherein the cast metal is transported in a transport direction on the solidification section and solidifies thereon. According to the invention, the device is characterized in that the solidification section is realized in the form of a horizontally extending conveyor element, wherein the liquid metal can be delivered to a first location of the solidification section, wherein the solidified metal can depart the conveyor element at a second location that is spaced apart from the first location in the transport direction, and wherein means for maintaining a desired mass flow of the strip departing the solidification section and/or a desired tension in the strip are provided downstream of the second location referred to the transport direction.

The means for maintaining a desired mass flow may comprise at least one driver that is arranged downstream of a transport section that is situated downstream of the second location referred to the transport direction. In this context, it is proposed, in particular, that the means for maintaining a desired mass flow comprise two drivers, between which the strip can be transported in the form of a loop. In this case, a movable roll (particularly a dancer roll or loop lifter) may be arranged between the two drivers in order to deflect the strip in the direction of its normal.

Alternatively, it would also be possible to realize the driver in the form of an S-roll set. One roll of the S-roll set may be arranged in a horizontally displaceable fashion.

It would furthermore be possible that at least one driver is formed by the rolls of a roll stand.

The means for maintaining a desired mass flow and for adjusting a strip tension of nearly zero as it is required for the delivery of the liquid metal may furthermore comprise at least one driver that is arranged upstream of a transport section that is situated downstream of the second location referred to the transport direction. This driver may comprise two cooperating rolls, between which the strip departing the solidification section is arranged.

The solidification section may be realized in the form of a conveyor belt and the driver may be realized in the form of a roll that presses the strip departing the solidification section against an idle roll of the conveyor belt.

At least one additional processing machine may be arranged downstream of the means for maintaining a desired mass flow. This machine may consist, for example, of a leveling machine, a rolling mill, shears or a coiler.

The invention proposes devices and control concepts that largely eliminate the negative effects of the additional processing on the cast strip, namely by adjusting and maintaining the tension and the mass flow constant. A high quality of the cast strip can be maintained in this fashion.

The proposed devices and control concepts for avoiding these effects may consist of two components, namely of a strip tension control in combination with a mass flow control.

Consequently, it can be ensured that a largely constant strip tension is adjusted in the region of the transport section, wherein the mass flow is also constant. The strip tension on the transport section preferably is greater than or nearly zero.

If a strip tension greater than zero is adjusted in the transport section, the device for controlling the strip tension ensures that the tension is practically zero in the region of the casting machine (i.e., in the solidification section). This is necessary because the cast strip can absorb less and less tension as the temperature increases and the permissible tension in the region of the melt delivery becomes zero.

BRIEF DESCRIPTION OF THE DRAWINGS

Embodiments of the invention are illustrated in the drawings. In these drawings.

DETAILED DESCRIPTION OF THE PREFERRED EMBODIMENTS

Figure 1:
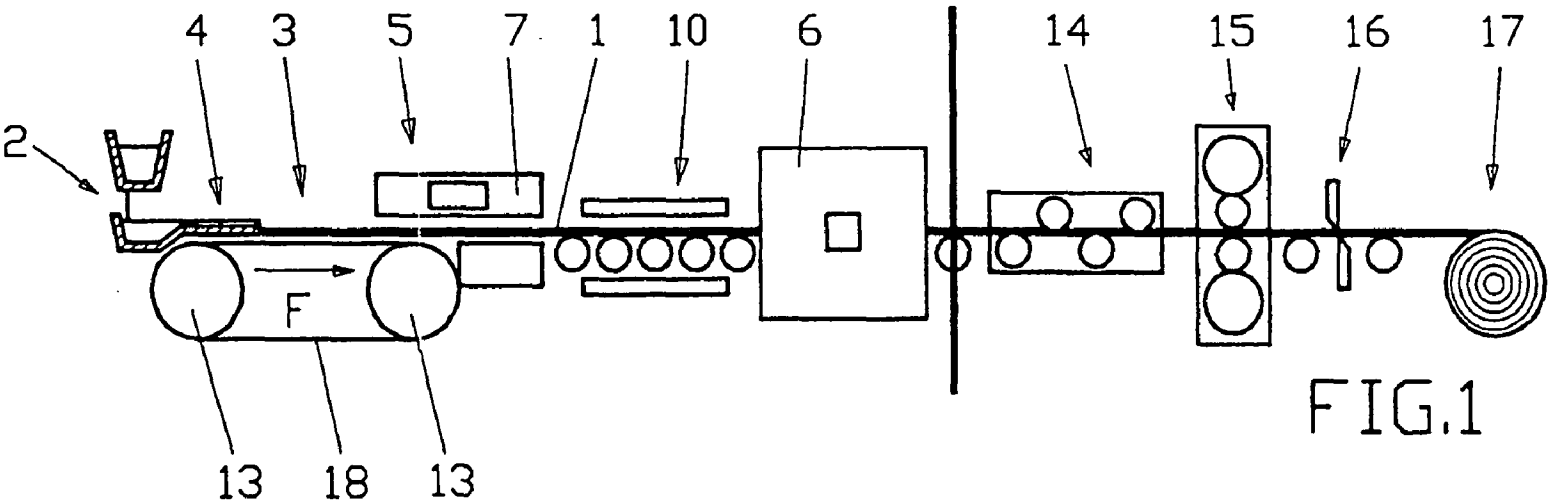
FIG. 1 schematically shows a device for manufacturing a strip of metal with a number of additional processing machines.

FIG. 1 shows a device for manufacturing a strip 1 by means of a casting process. One important component of the device is a solidification section 3 that is realized in the form of a conveyor belt 18 and held in the position shown by means of two idle rolls 13, wherein the upper side of the conveyor belt 18 moves in a transport direction F. At a first front location 4 referred to the transport direction, liquid metal is applied onto the conveyor belt 18, i.e., onto the solidification section 3, from a delivery vessel 2. The material solidifies during its transport and departs the conveyor belt 18 at a second location 5. A transport section 10 then delivers the cast strip 1 to additional processing machines 14, 15, 16, 17 that consist of a leveling machine 14, a rolling mill 15, shears 16 and a coiler 17 in the described embodiment.

The essential components of the present invention are means 6, 7 for maintaining a desired mass flow of the strip 1 departing the solidification section 3 and/or a desired tension in the strip 1. It is preferred to arrange part of the means 6 downstream of the transport section 10 referred to the transport direction F and part of the means 7 upstream of the transport section 10, however, downstream of the second location 5.

The means 6, 7 are designed for ensuring that the strip casting process is not affected by the processing steps taking place in the additional processing machines 14, 15, 16, 17. The means 6, 7 ensure that a constant strip mass flow is always withdrawn from the solidification section 3 and that a specified tensile stress is subsequently maintained in the cast strip 1 along the transport section 10.

Figure 2:
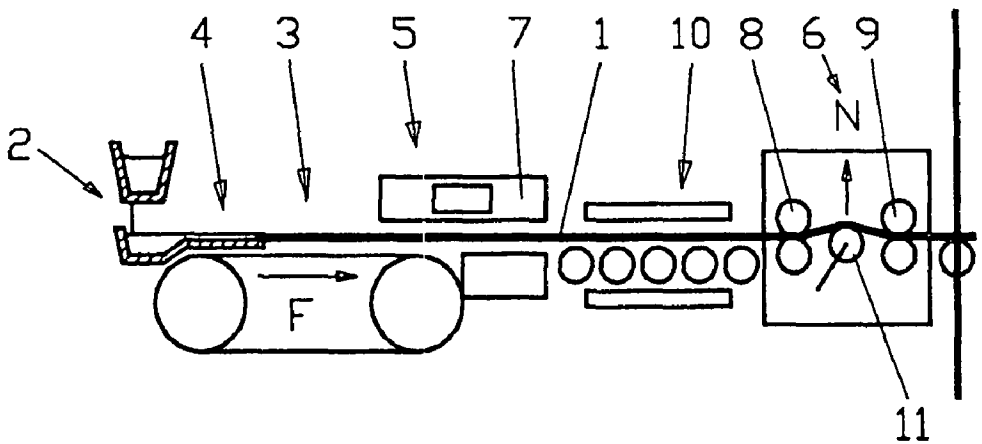
FIG. 2 shows a representation analogous to FIG. 1, wherein means for maintaining a desired mass flow and a desired strip tension are respectively illustrated in greater detail in a rear region.

FIGS. 2 to 6 show in greater detail how this can be achieved:

According to FIG. 2, the means 6 arranged downstream of the transport section 10 feature two drivers 8 and 9 that can be driven in a controlled fashion, wherein a dancer roll or a loop lifter 11 is positioned between the drivers 8, 9. The dancer roll or the loop lifter is able to deflect the strip 1 in the direction of the normal N such that the strip assumes a loop-like shape. Depending on the torque of the drivers 8, 9 and the deflection of the dancer roll 11, it can be ensured that irregularities caused by the additional processing machines 14, 15, 16, 17 are not transmitted to the strip situated upstream of the means 6. Consequently, the casting process is stabilized and homogenized such that the casting quality is correspondingly high.

According to this embodiment, the strip tension and mass flow control therefore consists of a system comprising drivers 8, 9 and a movably supported roll 11 (loop lifter or dancer roll). This makes it possible to carry out the ensuing processing steps with an adjustable level of tension in the strip. The tension can be adjusted in the region of the means 6 for decoupling the tension and maintained constant by means of the position control of the movably supported roll 11. The loop height is controlled by controlling the rotational speed of the drivers 8, 9 in order to thusly maintain the mass flow constant.

The function of the driver 8 or 9 may, if so required, also be fulfilled by a roll stand.

The operation can be realized with several variations:

1. If the driver 8 is not driven, it functions as a pair of hold-down rolls. In this case, the tension adjusted in the region of the transport section 10 is identical to that at the movable roll 11 (loop lifter, dancer roll).
2. If the driver 8 is driven in a torque-controlled fashion by a motor, a different tension can be adjusted in the region of the transport section 10, wherein the difference between the incoming and the outgoing tension is nearly constant at the driver.
3. If the driver 8 is driven in a speed-controlled fashion by a motor, nearly any other tension can be adjusted in the strip in the region of the transport section 10.

Figure 3:
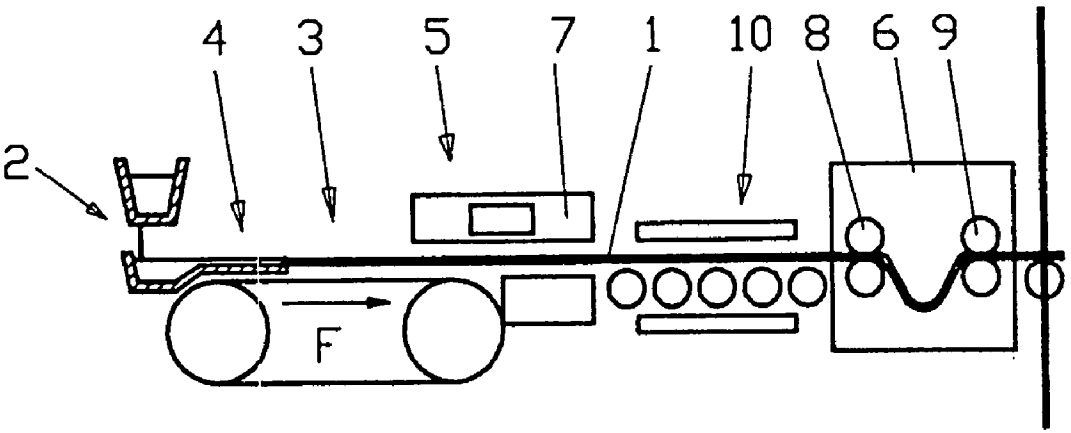
FIG. 3 shows an alternative variation of the device according to FIG. 2.

FIG. 3 shows an alternative embodiment of FIG. 2. In this case, no dancer roll is arranged between the two drivers 8 and 9 of the means 6. In this case, the transport of the strip 1 is regulated or controlled by the drive of the drivers 8, 9 such that a sagging, loop-shaped section of the strip 1 between the two drivers 8, 9 is used for compensating irregularities in the mass flow. The decoupling of the tension and the mass flow therefore is achieved with a free loop of the strip 1 between two speed-controlled drivers 8, 9 in this variation. In contrast to the method described with reference to FIG. 2, the process is carried out without an adjustable level of tension in this case, wherein the tensile stress is very low in the entire region and results from the weight of the sagging loop. Mass flow fluctuations are compensated by changing the loop height with the aid of the speed control of the drivers 8, 9. The strip tension resulting from the weight of the loop can be absorbed by the speed-controlled driver 8. Consequently, a nearly arbitrary tension can be adjusted in the region of the transport section by means of the driver 8. The function of the driver 9 may, if so required, also be fulfilled by a roll stand in this case.

Figure 4:
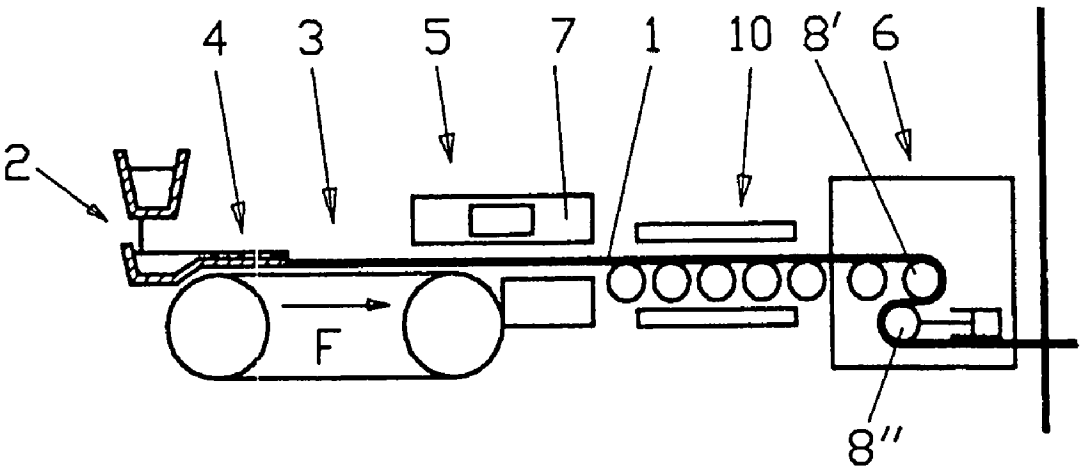
FIG. 4 shows another alternative variation of the device according to FIG. 2.

FIG. 4 shows another alternative. In this case, the decoupling of the tension and the mass flow is achieved with an S-roll set 8', 8" (if so required, in connection with a dancer roll). The lower roll 8" of the S-roll set 8', 8" can be adjusted in the horizontal direction as indicated by the motion element. The strip tension can be controlled with at least one of the speed-controlled S-rolls 8', 8". If a dancer roll is also utilized, this dancer roll ensures the decoupling of the mass flow.

Figure 5:
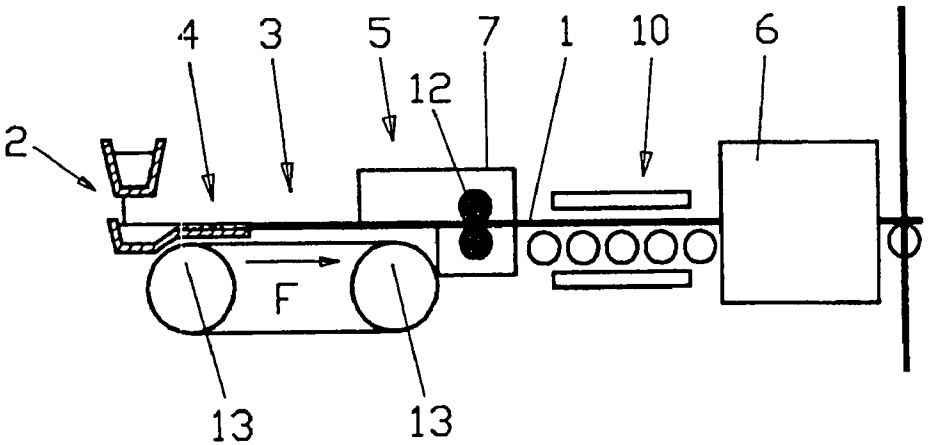
FIG. 5 shows a representation analogous to FIG. 1, wherein means for maintaining a desired mass flow and a desired strip tension are respectively illustrated in greater detail in a front region.
Figure 6:
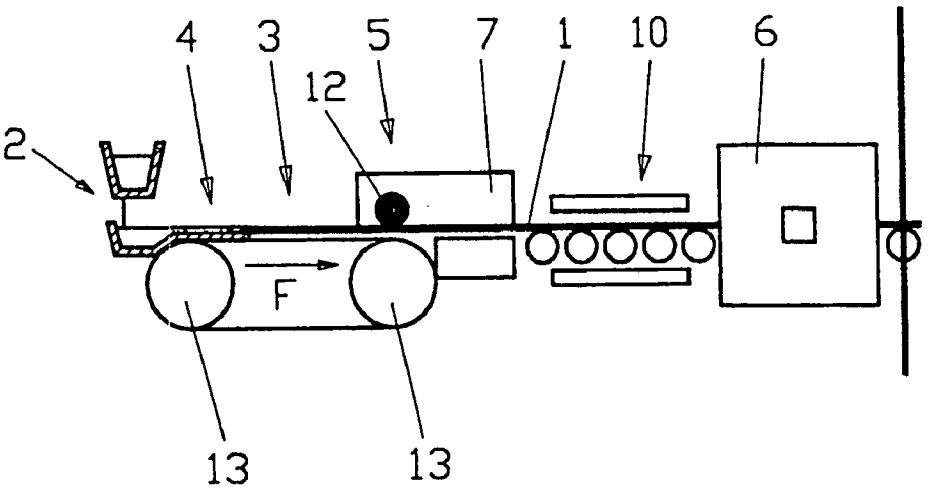
FIG. 6 shows an alternative variation of the device according to FIG. 5.

FIGS. 5 and 6 show more detailed representations of the means 7 that are situated upstream of the transport section 10 referred to the transport direction F.

In FIG. 5, the means 7 feature a driver 12 that consists of two cooperating rolls. Consequently, the pair of rolls of the driver 12 serves for controlling the tension in the strip 1 downstream of the casting machine (pour hole 2 together with the solidification section 3). It would also be possible to provide several pairs of drivers. This ensures that the strip tension is practically zero in the region of the casting machine as it is required for the melt delivery because the strip is not yet able to absorb any tensile stresses at this location. The two rolls of the driver 12 press against the cast strip with a defined force in order to produce the frictional engagement. At least one of the driver rolls is speed-controlled in this case.

Alternatively, it would be possible—as schematically indicated in FIG. 6—to absorb the tension by means of a top-roll 12 that is arranged at the end of the casting machine and presses against one of the idle rolls 13 of the conveyor belt 18. In this case, a force of pressure is exerted upon the strip and the tension is introduced into the speed-controlled top-roll 12 or the speed-controlled cast strip, respectively.

Figure 7:
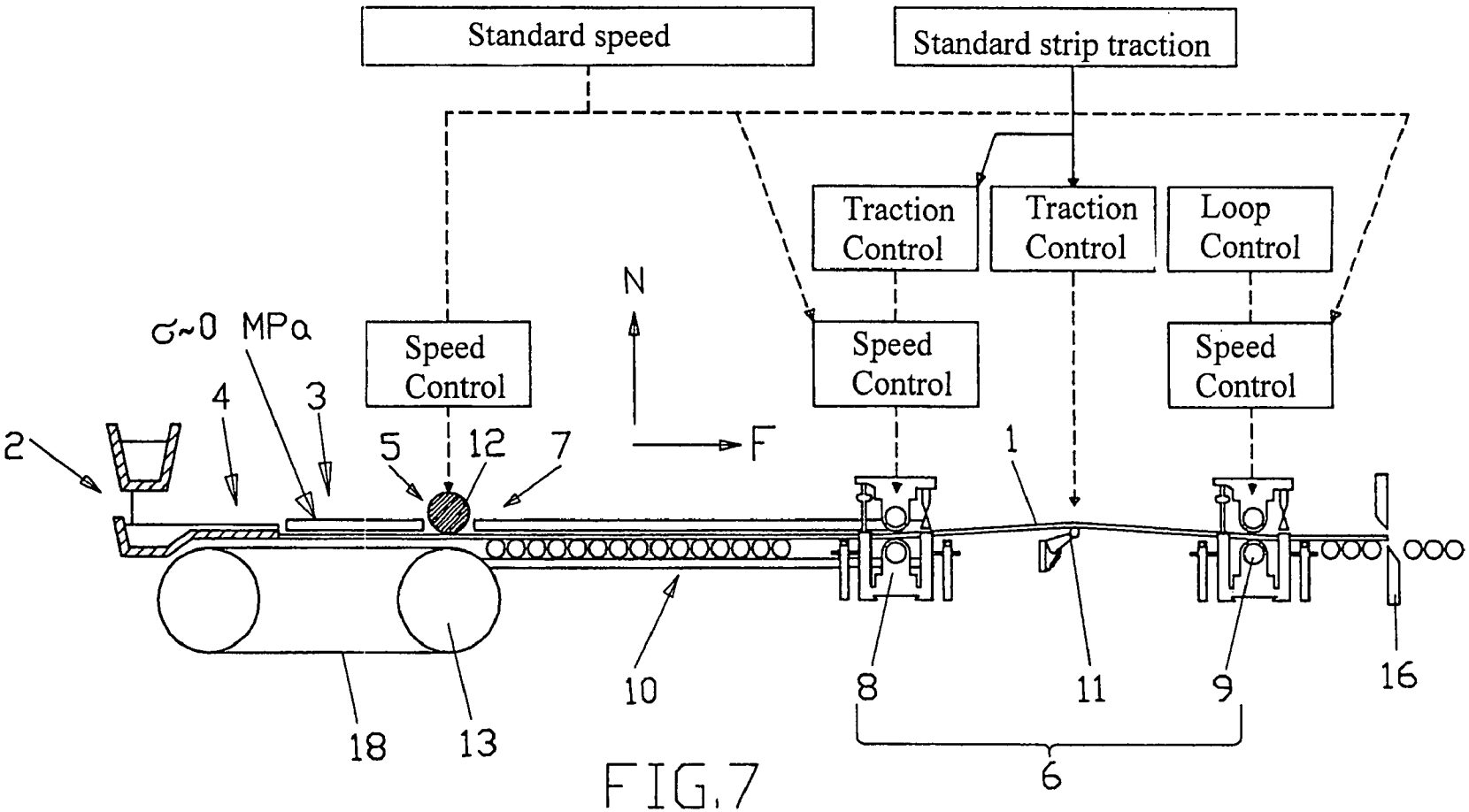
FIG. 7 shows another variation of the device with indications of the variables to be controlled.

FIG. 7 shows an even more detailed embodiment of the invention. In this case, a speed and strip tension control is realized as described above with reference to FIGS. 2 and 6. In this embodiment, a combination of tensile stress control and mass flow decoupling is realized, wherein two drivers 8 and 9 are arranged in the region of the means 6 and a dancer roll 11 is provided between the drivers; a driver roll 12 provided in the region of the means 7 presses against an idle roll 13 of the conveyor belt 18. In this embodiment, the drivers are speed-controlled, wherein the driver 9 maintains the mass flow constant with the loop control (by means of the dancer roll 11). The strip tension is adjusted to a constant level by positioning the loop lifter (dancer roll 11) accordingly. The driver 8 is speed-controlled with superimposed tension control and ensures a constantly adjustable level of tension in the region of the strip transport. The strip tension at this location is introduced into the motor torque of the upper roll via the top-roll 12 that lies on and presses against the strip.

Although the strip tension in the region of the solidification section 3 is essentially zero, the strip tension is significantly greater than zero in the region of the transport section 10. The level of tension may even be higher downstream of the driver 8.

The speed-controlled driver roll 12 operates with a specified speed, but a specified speed together with a specified strip tension in the case of the driver 8 results in a speed and torque control and therefore a tension control. The tension control realized by means of the dancer roll 11 leads to a control of the pivoting angle of the arm, on which the dancer roll is arranged, and therefore to a tension control in the form of a control of the actuating force of the arm. The driver 9 is speed-controlled with superimposed loop control and therefore mass flow control.

Figure 8A:
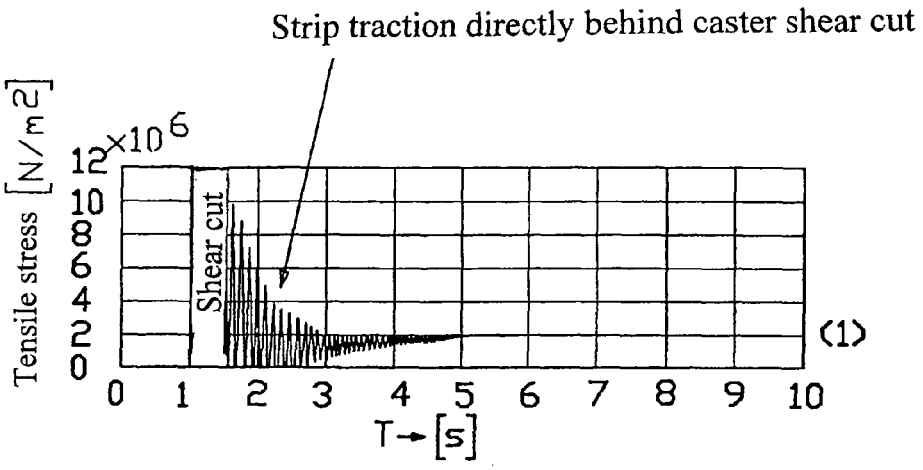
FIG. 8*a* shows the tensile stress in the strip as a function of the time without utilization of the inventive proposal.
Figure 8B:
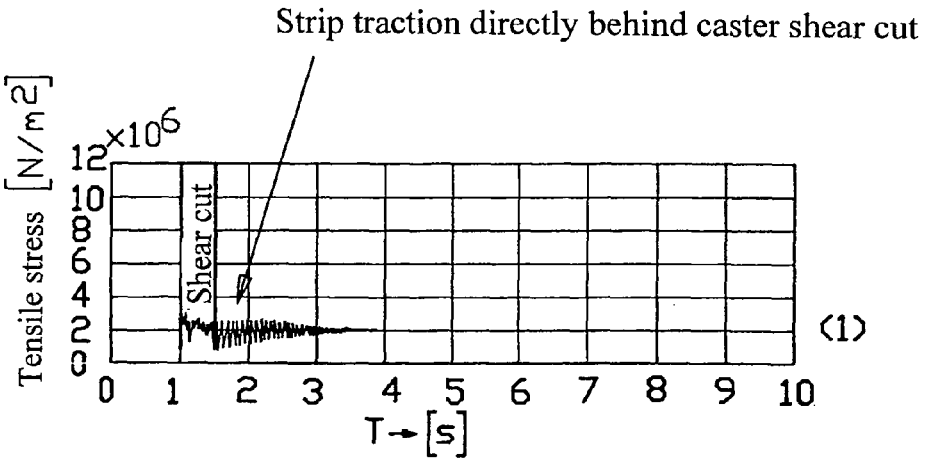
FIG. 8*b* shows the tensile stress in the strip as a function of the time when utilizing the inventive proposal.

FIG. 8 shows a comparison of the time history of the tensile stress in the strip 1 in the region of the strip transport downstream of the casting machine, namely for a known solution in FIG. 8*a* and for an embodiment according to the invention in FIG. 8*b*.

The tensile stress in the strip is. affected due to the actuation of shears 16 (see FIG. 1) during the course of an additional processing step. The shears 16 produce a cut such that a deviation from the ideally constant strip motion also results in the region of the strip transport.

The shears 16 pull on the strip 1 while the cut is produced such that high tensions that could propagate in the direction of the liquid phase and lead to the initially described problems would occur in the region of the strip transport without the inventive solution according to FIG. 8*a*.

According to FIG. 8*b*, the strip tension can be maintained nearly constant under identical disturbances by utilizing the inventive solution. Disturbances of the casting process therefore can be largely prevented, but are significantly reduced in comparison with FIG. 8*a* in any case.

LIST OF REFERENCE SYMBOLS

1 Strip
2 Delivery vessel
3 Solidification section
4 First location
5 Second location
6, 7 Means for maintaining a desired mass flow and for maintaining the tension
8 Driver
8' Roll of the S-roll set
8" Roll of the S-roll set
9 Driver
10 Transport section
11 Movable roll (dancer roll)
12 Driver
13 Idle roll
14 Additional processing machine (leveling machine)
15 Additional processing machine (rolling mill)
16 Additional processing machine (shears)
17 Additional processing machine (coiler)
18 Conveyor belt
F Transport direction
N Normal

The invention claimed is:

1. A device for manufacturing a metal strip (1), comprising a solidification section (3) formed as a horizontally extending conveyor element for transporting cast metal in a transport direction (F) and having a first location (4) and a second location (5) spaced from the first location in the transport direction (F); a delivery vessel (2) for delivering liquid metal to the first location of the solidification section (3); means provided at or downstream of the second location for maintaining a desired tension in a metal strip; and a rolling mill located downstream of the tension maintaining means of the metal strip (1) for rolling the metal strip;

wherein tension maintaining means (6, 7) comprises two drivers (8, 9) arranged downstream of a transport section (10), which is located downstream of the second location (5) in the transport direction (F), for transporting the metal strip in form of a loop, and a movable roll (11) arranged between the two drivers (8, 9) for deflecting the strip in a direction of its normal (N).

2. The device according to claim 1, wherein one of the two drivers (8) is realized in form of an S-roll set (8', 8").

3. The device according to claim 2, wherein one roll (8") of the S-roll set (8', 8") is arranged in a horizontally displaceable manner.

4. The device according to claim 1, wherein at least one additional processing machine (14, 15, 16, 17) is arranged downstream of the tension maintaining means (6, 7).

5. The device according to claim 1, wherein at least one leveling machine (14) is arranged downstream of the tension maintaining means (6, 7).

6. The device according to claim 1, wherein at least one set of shears (16) is arranged downstream of the means (6, 7) for maintaining a desired tension in the strip.

7. The device according to claim 1, wherein at least one coiler (17) is arranged downstream of the means (6, 7) for maintaining a desired tension in the strip.

8. A device for manufacturing a metal strip (1), comprising a solidification section (3) formed as a horizontally extending conveyor element for transporting cast metal in a transport direction (F) and having a first location (4) and a second location (5) spaced from the first location in the transport direction (F); a delivery vessel (2) for delivering liquid metal to the first location of the solidification section (3); means provided at or downstream of the second location for maintaining a desired tension of the metal strip (1); and a rolling mill provided downstream of the tension maintaining means for rolling the strip, wherein means (6, 7) for maintaining a desired tension in the strip comprises at least one driver (8, 9) arranged downstream of a transport section (10) which is located downstream of the second location (5) in the transport direction (F), and formed as an S-roll set (8', 8"), and wherein one roll (8") of the S-roll set (8', 8") is arranged in a horizontally displaceable manner.

* * * * *